US011207906B2

(12) United States Patent
Satake et al.

(10) Patent No.: US 11,207,906 B2
(45) Date of Patent: Dec. 28, 2021

(54) CLEANING DEVICE AND IMAGE FORMING APPARATUS

(71) Applicant: KYOCERA Document Solutions Inc., Osaka (JP)

(72) Inventors: Kenichi Satake, Osaka (JP); Takeshi Watanabe, Osaka (JP); Hiroki Sakane, Osaka (JP); Yasuhiro Michishita, Osaka (JP); Masato Usui, Osaka (JP); Yuzuru Yuasa, Osaka (JP); Yusuke Tamekuni, Osaka (JP); Shinobu Ohata, Osaka (JP); Naoto Miyakoshi, Osaka (JP); Shunsuke Yamasaki, Osaka (JP); Hiroatsu Tamai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/013,413

(22) Filed: Sep. 4, 2020

(65) Prior Publication Data

US 2021/0070074 A1 Mar. 11, 2021

(30) Foreign Application Priority Data

Sep. 6, 2019 (JP) ..... JP2019-162867

(51) Int. Cl.
*B41J 29/17* (2006.01)

(52) U.S. Cl.
CPC ..... *B41J 29/17* (2013.01)

(58) Field of Classification Search
CPC ..... B41J 29/17; B41J 13/02; B41J 11/007
See application file for complete search history.

(56) References Cited

U.S. PATENT DOCUMENTS

2010/0232849 A1* 9/2010 Nanataki ..... G03G 15/2025 399/327
2017/0113476 A1* 4/2017 Hara ..... B41J 29/17

FOREIGN PATENT DOCUMENTS

JP 2004-345805 A 12/2004
JP 2006-117420 A 5/2006
JP 4374462 B2 12/2009

* cited by examiner

*Primary Examiner* — Scott A Richmond
(74) *Attorney, Agent, or Firm* — Studebaker & Brackett PC

(57) ABSTRACT

A cleaning device includes a cleaning unit which removes foreign matter adhered on a conveyance face of a conveyance member conveying a sheet, by using a belt shaped web; and a unit moving mechanism which displaces the cleaning unit to a cleaning position where the cleaning unit comes into contact with the conveyance face and to a separation position separated away from the cleaning position. The cleaning unit includes a delivery roller delivering the web, a pressure roller bringing the web pressure-contact with the conveyance face and a winding roller winding the web passed the conveyance face. The cleaning unit is tilted such that a cleaning face of the web between the pressure roller and the winding roller faces upward as the cleaning unit is displaced from the cleaning position to the separation position.

11 Claims, 12 Drawing Sheets

CLEANING DEVICE AND IMAGE FORMING APPARATUS

INCORPORATION BY REFERENCE

This application is based on and claims the benefit of priority from Japanese Patent application No. 2019-162867 filed on Sep. 6, 2019, which is incorporated by reference in its entirety.

TECHNICAL FIELD

The present disclosure relates to a cleaning device and an image forming apparatus.

BACKGROUND

In an image forming apparatus, such as a printer, a conveyance path for a sheet is formed by conveyance members, such as various conveyance rollers and conveyance belts. During the conveyance of the sheet by the conveyance members, if sheet powder adheres on the conveyance face of the conveyance member, a conveyance failure may occur. Thereby, the image forming apparatus is known, in which a cleaning device to remove the sheet powder from a surface of a pair of resist rollers as the conveyance member is provided. The cleaning device cleans the resist roller by bringing a web sequentially delivered from a web roll into pressure-contact with the conveyance surface of the rotating resist roller.

SUMMARY OF THE INVENTION

In accordance with one aspect of the present disclosure, a cleaning device includes a cleaning unit which removes foreign matter adhered on a conveyance face of a conveyance member conveying a sheet, by using a belt shaped web; and a unit moving mechanism which displaces the cleaning unit to a cleaning position where the cleaning unit comes into contact with the conveyance face and to a separation position separated away from the cleaning position. The cleaning unit includes a delivery roller delivering the web, a pressure roller bringing the web pressure-contact with the conveyance face and a winding roller winding the web passed the conveyance face. The cleaning unit is tilted such that a cleaning face of the web between the pressure roller and the winding roller faces upward as the cleaning unit is displaced from the cleaning position to the separation position.

In accordance with one aspect of the present disclosure, an image forming apparatus includes an image forming part which forms an image on the sheet, and the cleaning device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
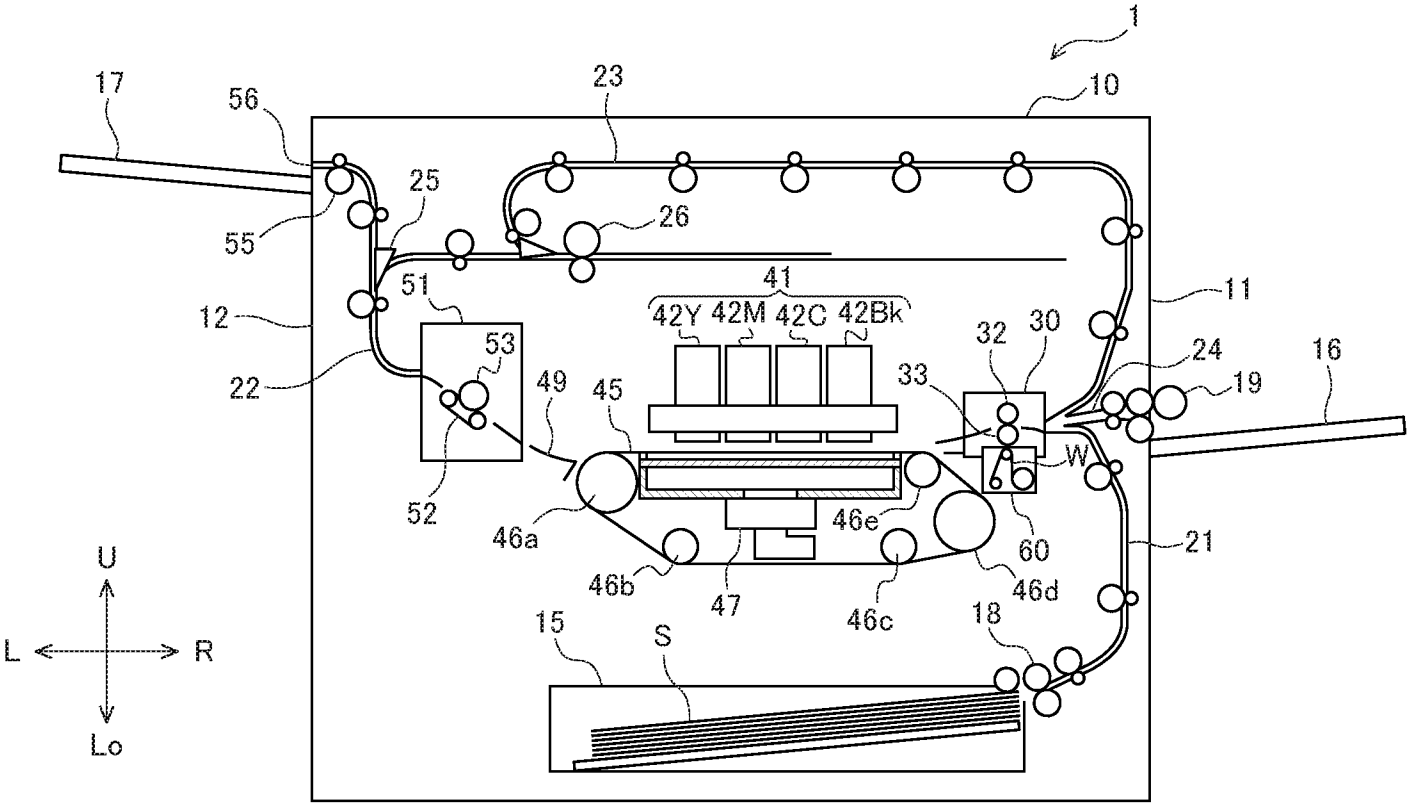
FIG. 1 is a view schematically showing an image forming apparatus in the present embodiment.

Hereinafter, with reference to the attached drawings, an image forming apparatus including a cleaning device in the present embodiment will be described. FIG. is a view schematically showing the image forming apparatus in the present embodiment. For convenience of explanation, a front side of a paper surface on which FIG. 1 is drawn is defined as a front side of the image forming apparatus, and a left-and-right direction is described based on a direction in which the image forming apparatus is viewed from the front side. "L", "R", "U", "Lo", "Fr" and "Rr" marked in each figure respectively show the left side, the right side, the upper side, the lower side, the front side and the rear side of the image forming apparatus.

As shown in FIG. 1, the image forming apparatus 1 is an inkjet type printer which ejects an ink drop to form an image on a sheet S, and is performable a one-side printing and a double-side printing on the sheet S. The image forming apparatus 1 includes a box-like housing 10 in which various units are stored. In the lower portion of the housing 10, a sheet feeding cassette 15 in which the sheet S is placed is stored, and on the right side face 11 of the housing 10, a manual bypass tray 16 on which the sheet S is placed manually is provided. On the upper portion of the left side face 12 of the housing 10, a discharge tray 17 on which the sheet S with the formed image is stacked is provided.

In the right side portion in the housing 10, a first conveyance path 21 is formed, along which the sheet S is conveyed from the sheet feeding cassette 15 to an image forming part 41 provided in the center portion of the housing 10. On an upstream portion of the first conveyance path 21, a sheet feeding part 18 is provided, and on a downstream portion of the first conveyance path 21, a resist roller device 30 is provided. The downstream portion of the first conveyance path 21 is connected to a feeding path 24 extending from the manual bypass tray 16, and on the feeding path 24 extending from the manual bypass tray 16, a sheet feeding part 19 is provided. The sheet feeding part 18 is formed so as to feed the sheet S from the sheet stack in the sheet feeding cassette 15, and the sheet feeding part 19 is formed so as to feed the sheet S from the sheet stack on the manual bypass tray 16.

The resist roller device 30 includes a pair of resist rollers 32 and 33 facing each other in the upper-and-lower direction. On a downstream side of the pair of resist rollers 32 and 33, the image forming part 41 and a conveyance belt 45 are provided. The pair of resist rollers 32 and 33 corrects a skew of the sheet S, and sends the sheet S to the conveyance belt 45 in accordance with an ink drop ejecting operation in the image forming part 41. Below the resist roller device 30, a cleaning device 60 to clean the resist rollers 32 and 33 periodically is provided. The cleaning device 60 cleans the conveyance face of the lower resist roller 33 using a belt shaped web W at the double-side printing.

In the image forming part 41, a plurality of (four, in the present embodiment) line heads 42Bk, 42C, 42M and 42Y through which an ink drop is ejected is provided. The line heads 42Bk, 42C, 42M and 42Y eject the ink drops of black, cyan, magenta and yellow, respectively. The conveyance belt 45 is bridged around a plurality of tension rollers 46*a* to 46*e* set below the image forming part 41. The conveyance belt 45 has a plurality of through holes, and in the hollow space of the conveyance belt 45, a suction part 47 which generates negative pressure in the through holes of the conveyance belt 45 at a position facing the image forming part 41 is provided.

The sheet S sent from the resist rollers 32 and 33 is sucked to the conveyance belt 45 by the negative pressure in the through holes of the conveyance belt 45. Then, the ink drops are successively ejected from the line heads 42Bk, 42C, 42M and 42Y on the sheet S sucked to the conveyance belt 45, and then a full color image is formed on the sheet S by the black, cyan, magenta and yellow inks. After the sheet S is passed below the line heads 42Bk, 42C, 42M and 42Y, the suction of the sheet S to the conveyance belt 45 is released, and the sheet S with the formed image is guided by a discharge guide 49 to a curl correction device 51.

In the left side portion in the housing 10, a second conveyance path 22 is formed, along which the sheet S is conveyed from the curl correction device 51 to the discharge tray 17. On a middle of the second conveyance path 22, a branch member 25 is provided, and on a downstream portion of the second conveyance path 22, a discharge part 55 is provided. The curl correction device 51 corrects a curl of the sheet S after the ink is dried, by using a conveyance belt 52 and a correction roller 53. The branch member 25 switches a conveyance direction of the sheet S into the discharge tray 17 and into a third conveyance path 23 described later. The discharge part 55 is formed so as to discharge the sheet S with the formed image on the discharge tray 17 through a discharge port 56 of the left side face 12 of the housing 10.

In the upper portion in the housing 10, the third conveyance path 23 is formed, along which the sheet S is conveyed from the branch member 25 on a middle of the second conveyance path 22 to the resist roller device 30 on the downstream side portion of the first conveyance path 21. On a middle of the third conveyance path 23, a sheet inversion part 26 is provided, on which the sheet S is inverted upside down. When the sheet S is conveyed to the third conveyance path 23, the sheet S is switched back on the sheet inversion part 26, and the sheet S inverted upside down is conveyed to the resist roller device 30. Then, the sheet S whose back face faces upward is conveyed to the image forming part 41 from the resist rollers 32 and 33.

At the image forming operation of the image forming apparatus 1, the sheet S is fed from the sheet feeding part 18 or 19 from the sheet feeding cassette 15 or the manual bypass tray 16, and then conveyed to the resist roller device 30. In accordance with the image forming operation, the sheet S is sent from the resist roller device 30 to the conveyance belt 45, and an image is formed on the front surface of the sheet S in the image forming part 41. At the one-side printing, after the curl of the sheet S is corrected by the curl correction device 51, the sheet S is conveyed through the second conveyance path 22 to the discharge port 56, and then the sheet with the image formed on one face is discharged by the discharge part 55 on the discharge tray 17.

At the double-side printing, after the curl of the sheet S is corrected by the curl correction device 51, the sheet S with the image formed on the front face is inverted upside down on the third conveyance path 23, and then conveyed to the resist roller device 30 again. The sheet S is sent from the resist roller device 30 to the conveyance belt 45, and an image is formed on the back face of the sheet S in the image forming part 41. Then, after the curl of the sheet S is corrected by the curl correction device 51, the sheet with the image formed on both the front and back faces is discharged by the discharge part 55 on the discharge tray 17.

At the double-side printing, the sheet S is conveyed from the third conveyance path 23 to the resist roller device 30 in a state where the front face with the formed image faces downward. At this time, if pigment in the ink on the surface of the sheet S adheres on the lower resist roller 33, the pigment is transferred from the lower resist roller 33 to the upper resist roller 32, and the next sheet S may be contaminated with the pigment by the pair of resist rollers 32 and 33. Alternatively, sheet powder may generate by friction between the resist rollers 32 and 33 and the sheet S, and then adhere on the resist rollers 32 and 33. This may cause conveyance failure of the sheet S.

Thereby, the resist roller device 30 is configured such that foreign matter, such as the pigment contained in the ink and the sheet powder, adhered on the conveyance face of the lower resist roller 33 is removed by the cleaning device 60. The cleaning face of the belt shaped web W of the cleaning device 60, which is a face facing the resist roller 33, is brought into pressure-contact with the conveyance face of the lower resist roller 33, and the foreign matter is scraped by the web W from the conveyance face of the resist roller 33. The cleaning device 60 is configured to feed the belt shaped web W intermittently, and the unused portion of the web W is brought into contact with the conveyance face of the resist roller 33 while the used portion of the web W is collected.

Figure 2A:
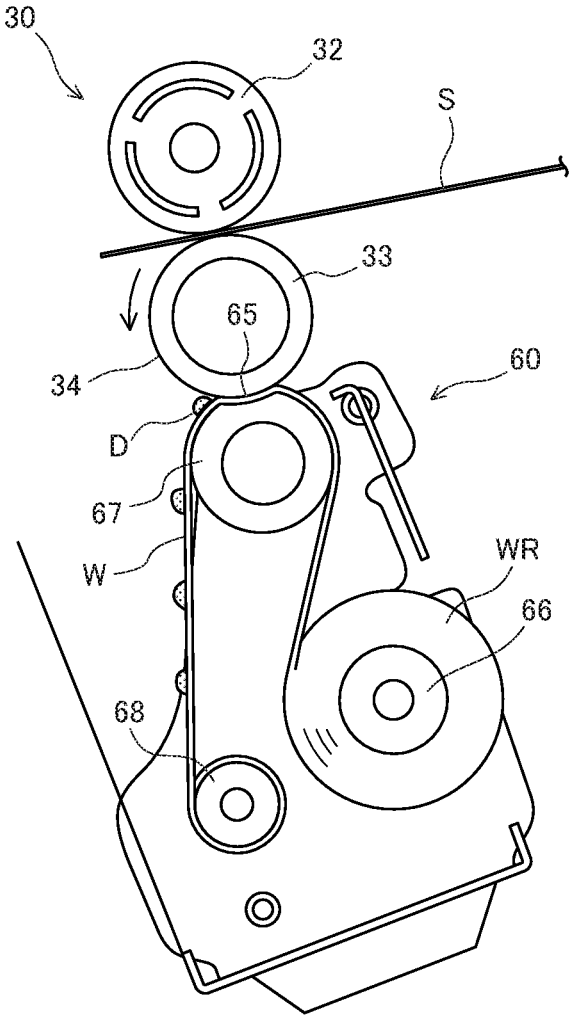
FIG. 2A is a view showing one example of a cleaning operation of a cleaning unit in a comparative example.

As shown in FIG. 2A, at the cleaning operation for the lower resist roller 33, the resist roller 33 is rotated while the web W is brought into pressure-contact with the conveyance face 34 of the resist roller 33 by a pressure roller 67 of the cleaning device 60. The foreign matter D adhered on the conveyance face 34 is blocked by a contact area 65 between the web W and the conveyance face 34 of the resist roller 33, and then the foreign matter D is scraped from the conveyance face 34. Then, near the contact area 65 between the web W and the conveyance face 34 of the resist roller 33, that is, on a front side of the contact area 65 in the rotational direction (the counterclockwise direction in figure) of the resist roller 33, the powdery foreign matter D is accumulated.

In order to keep a cleaning performance of the cleaning device 60 constant, the used portion of the web W is fed from the pressure roller 67 to a winding roller 68, and then the foreign matter D is transferred from the front side of the contact area 65. The outer circumferential face of the pressure roller 67 is made of elastic material having a small Young's modulus such as sponge. Then, the pressure roller 67 is partially deformed during the cleaning of the resist roller 33, and a contact area between the cleaning face of the web W and the conveyance face 34 of the resist roller 33 becomes large. When the pressure roller 67 is pressed on the conveyance face 34 for a long period, the pressure roller 67 is permanently deformed, and then the rotation of the pressure roller 67 becomes unstable.

Figure 2B:
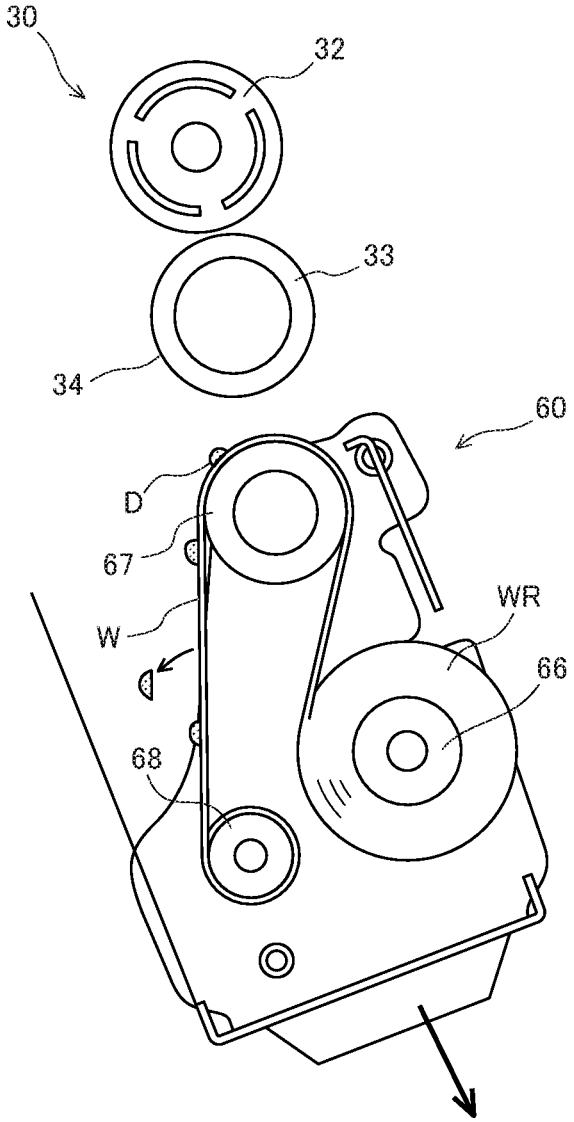
FIG. 2B is a view showing one example of a separation operation of the cleaning unit in the comparative embodiment.

Thereby, as shown in FIG. 2B, at the non-cleaning operation for the resist roller 33, the pressure roller 67 is separated away from the lower resist roller 33. At this time, the feeding of the web W is stopped, and the foreign matter D adheres on the used web W fed from the pressure roller 67 to the winding roller 68. Because the web W between the pressure roller 67 and the winding roller 68 extends approximately in the vertical direction, if adhesion force of the foreign matter D to the cleaning face of the web W is weak, the foreign matter D may be removed from the cleaning face of the web W when the pressure roller 67 is separated away from the resist roller 33, and the inside of the housing 10 may be contaminated with the removed foreign matter D.

Figure 8A:
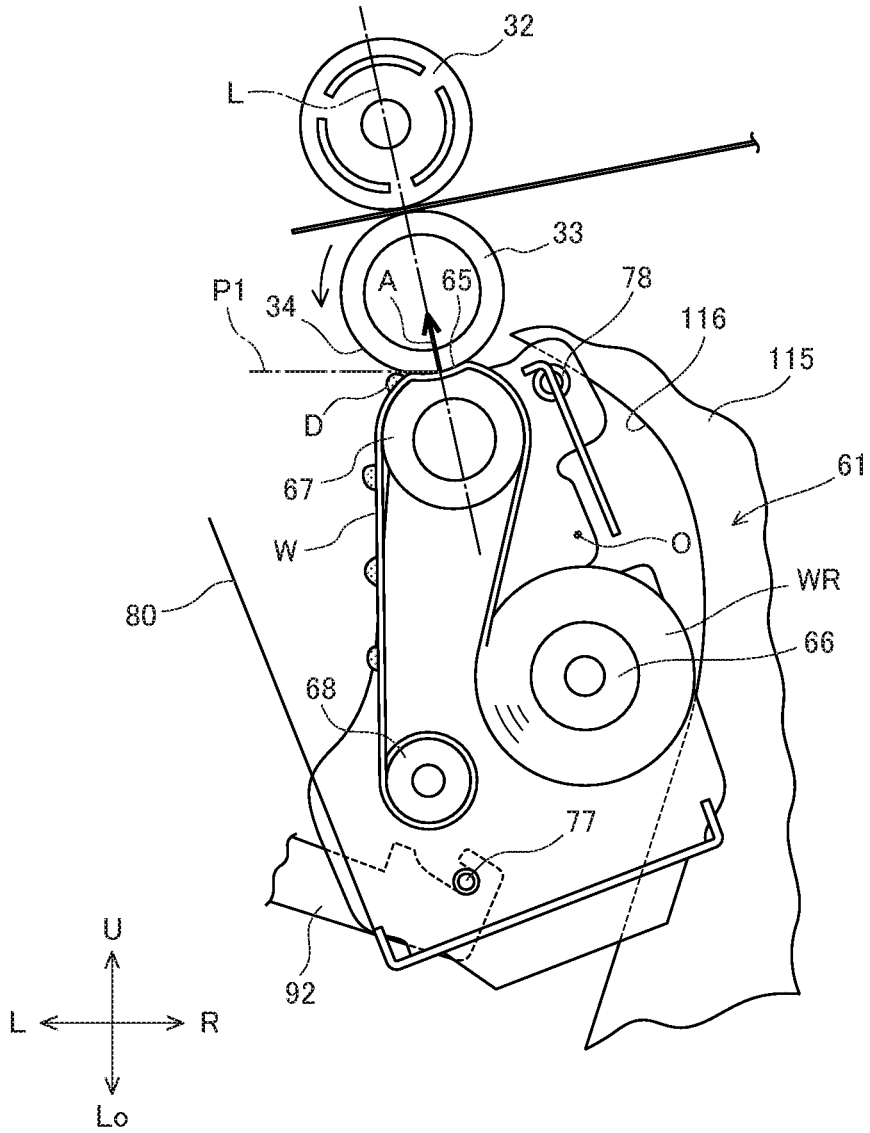
FIG. 8A is a transition diagram showing a separation operation of the cleaning unit in the present embodiment.
Figure 8B:
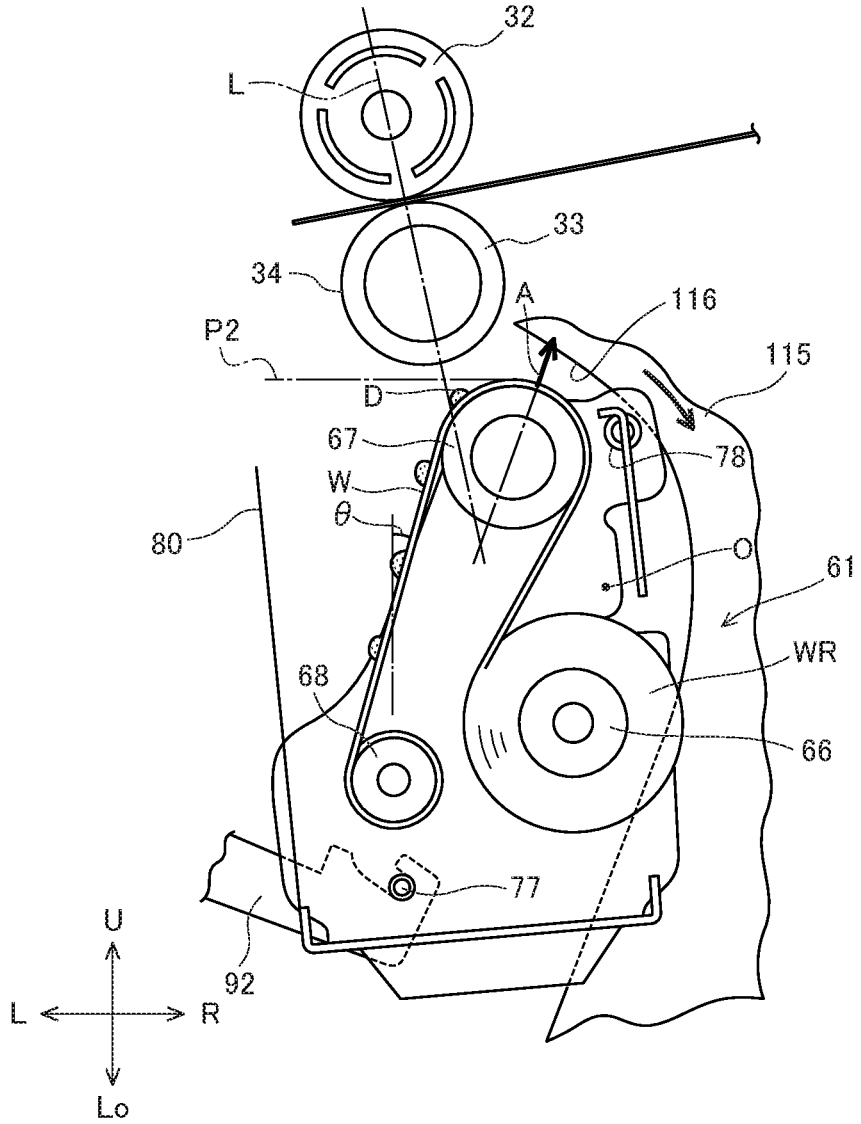
FIG. 8B is a transition diagram showing the separation operation of the cleaning unit in the present embodiment.

Then, in the present embodiment, as the pressure roller 67 is separated away from the lower resist roller 33, the cleaning face of the web W between the pressure roller 67 and the winding roller 68 faces upward (refer to FIG. 8B). The extending direction of the web W between the pressure roller 67 and the winding roller 68 is tilted with respect to the approximately vertical direction, and the cleaning face of the web W is positioned under the foreign matter D. Then, even if the adhesion force of the foreign matter D to the web W is weak, it becomes possible to prevent the contamination of the inside of the housing 10 with the foreign matter D removed from the web W by a simple configuration in which the cleaning face of the web W on which the foreign matter D adheres faces upward.

Figure 3:
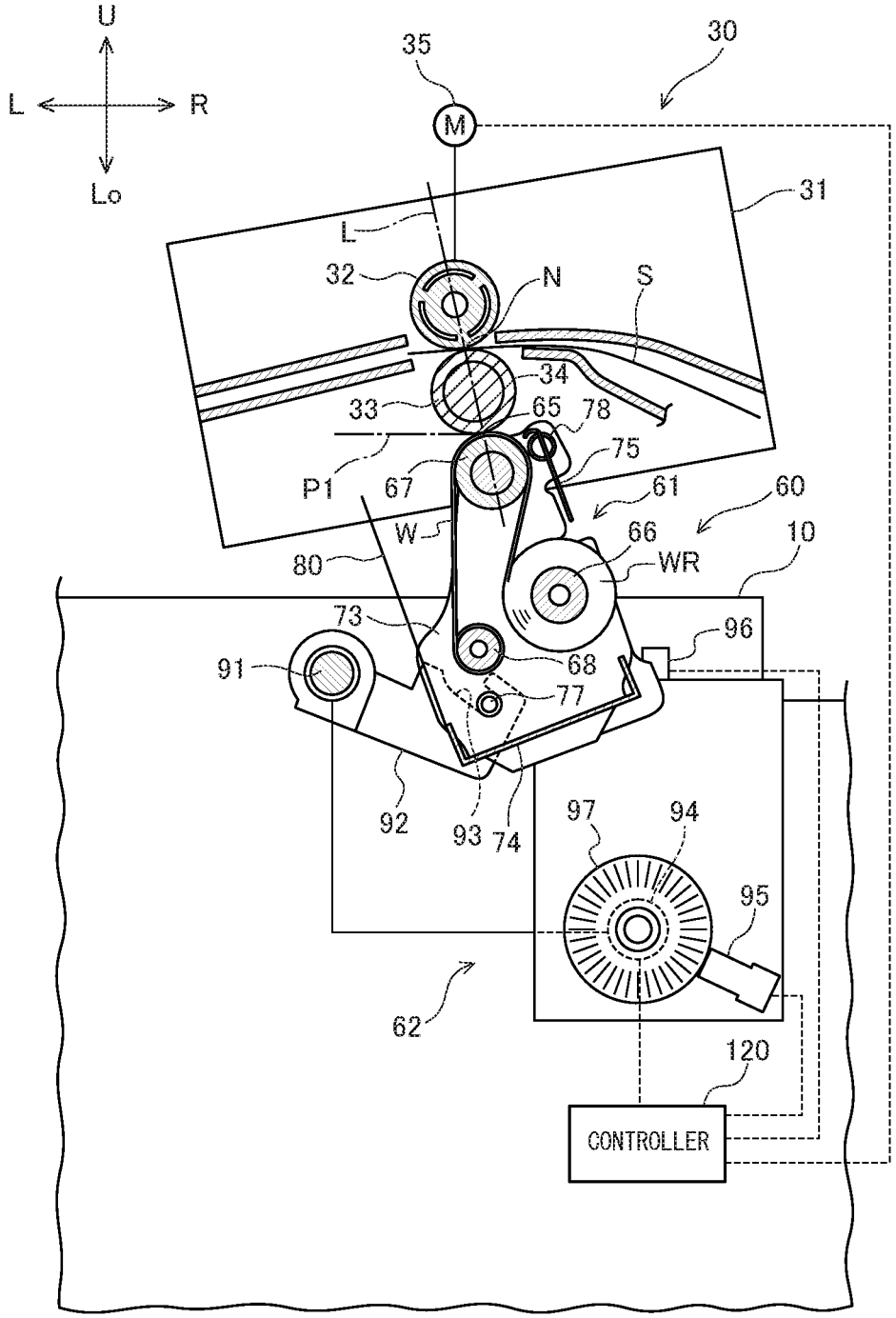
FIG. 3 is a view schematically showing a cleaning device and a resist roller device in the present embodiment.
Figure 4:
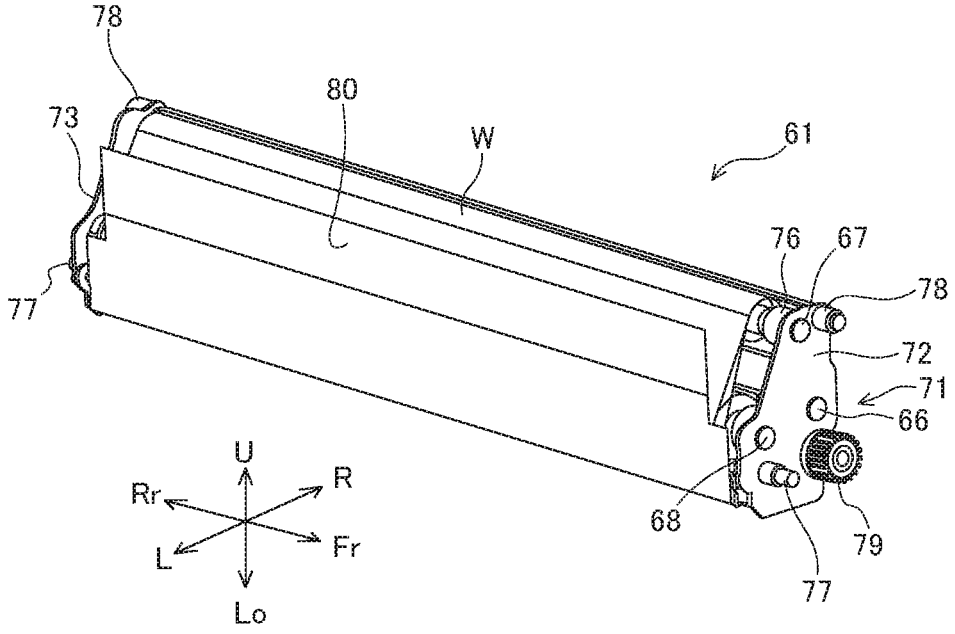
FIG. 4 is a perspective view showing the cleaning unit in the present embodiment.
Figure 5:
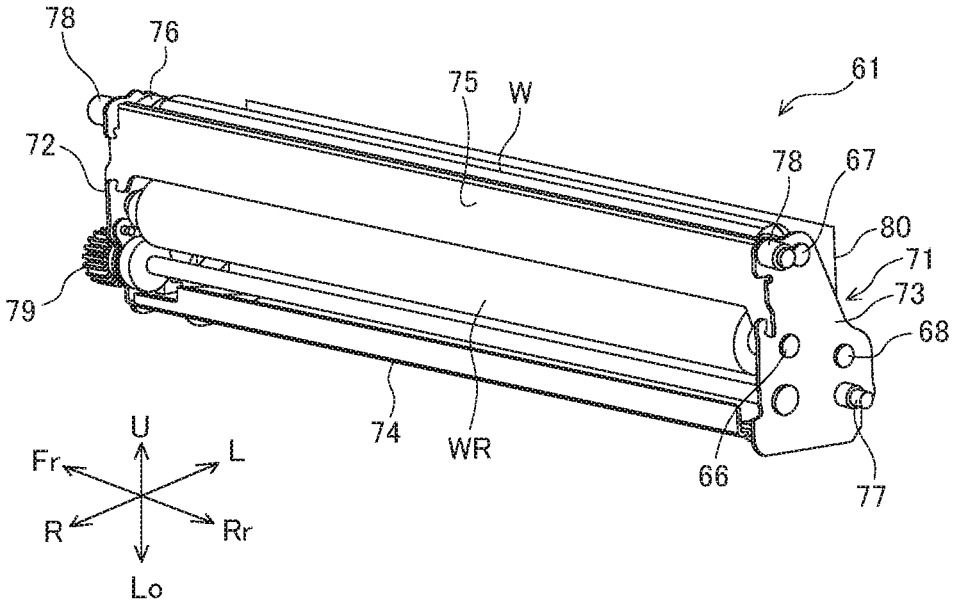
FIG. 5 is a perspective view showing the cleaning unit in the present embodiment.
Figure 6:
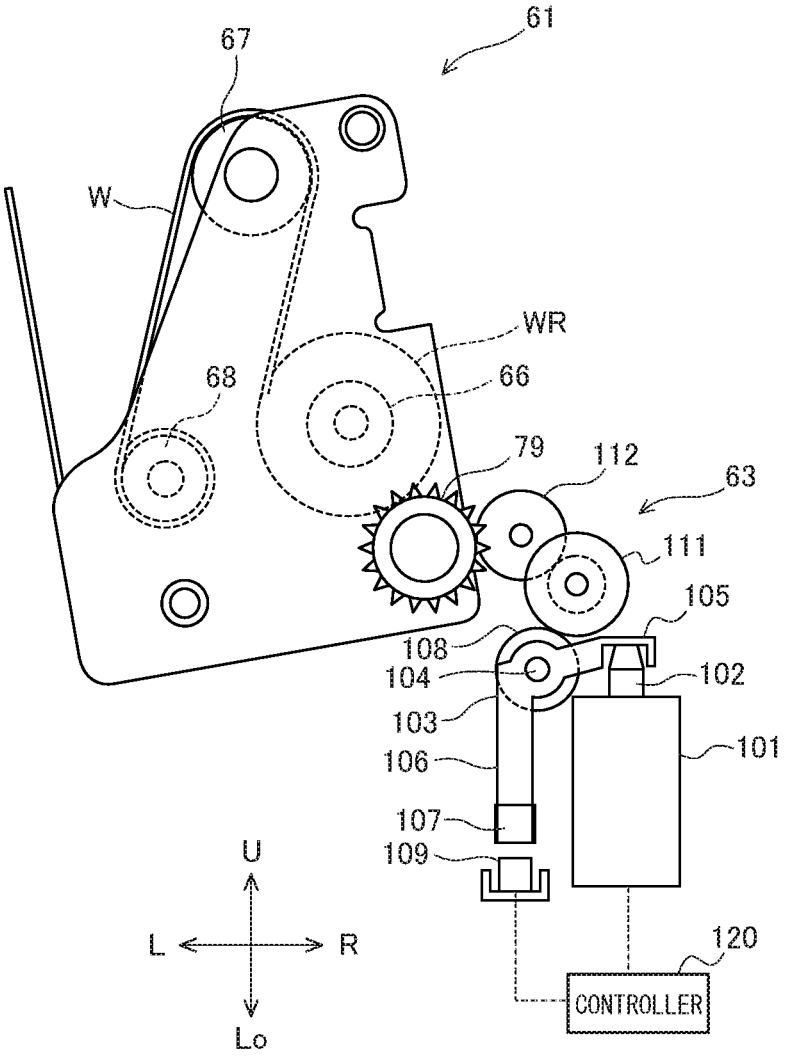
FIG. 6 is a view schematically showing the cleaning unit and a web driving mechanism in the present embodiment.

Hereinafter, the cleaning device will be described. FIG. 3 is a view schematically showing the cleaning device and the resist roller device in the present embodiment. FIG. 4 and FIG. 5 are perspective views showing a cleaning unit in the present embodiment. FIG. 6 is a view schematically showing the cleaning unit and a web driving mechanism in the present embodiment.

As shown in FIG. 3, the resist roller device 30 includes a resist housing 31 in which the conveyance path for the sheet S is formed. On the side walls of the resist housing 31, the pair of upper and lower resist rollers 32 and 33 is supported in a rotatable manner. The pair of resist rollers 32 and 33 is connected to a resist motor 35 via a driving force transmission mechanism (not shown). The sheet S is nipped in a nip N between the resist rollers 32 and 33, and then the resist rollers 32 and 33 are rotated by the driving force of the resist motor 35 to convey the sheet S to the image forming part 41 (refer to FIG. 1).

The upper resist roller 32 is made of metallic roller. The lower resist roller 33 is formed by covering the outer circumferential face of the rubber roller with a PFA (tetrafluoroethylene/perfluoroalkoxyethylene copolymer resin) tube. A line L coupling a rotational center of the upper resist roller 32 and a rotational center of the lower resist roller 33 is inclined with respect to the vertical direction at an acute angle (for example, 10 degrees). That is, the lower resist roller 33 is disposed at a position slightly displaced from the upper resist roller 32 on an upstream side in the conveyance direction of the sheet S (on the right side).

Below the resist roller device 30, the cleaning device 60 is set. The cleaning device 60 includes a cleaning unit 61 which is attachable and detachable to and from the housing 10, and a unit moving mechanism 62 and a web driving mechanism 63 (refer to FIG. 6) which are unmovably attached to the housing 10. By attaching the cleaning unit 61 to the housing 10, the unit moving mechanism 62 and the web driving mechanism 63 are coupled with the cleaning unit 61. The unit moving mechanism 62 displaces the cleaning unit 61 in the upper-and-lower direction, and the web driving mechanism 63 transmits a driving force for driving the web to the cleaning unit 61.

The cleaning unit 61 is configured to remove the foreign matter D adhered on the conveyance face 34 of the lower resist roller 33 by the belt shaped web W. The cleaning unit 61 includes a delivery roller 66 which delivers the web W, the pressure roller 67 which presses the web W on the conveyance face 34, and the winding roller 68 which winds the web W passed the conveyance face 34. Around the outer circumferential face of the delivery roller 66, a web roll WR in which the web W is wound into a roll is attached, and the tip end of the web W delivered from the web roll WR is wound around the outer circumferential face of the pressure roller 67 and then fixed to the outer circumferential face of the winding roller 68.

The web W is made of belt shaped fabric material such as nonwoven fabric, and brought into pressure-contact with the conveyance face 34 of the lower resist roller 33 by the pressure roller 67. The outer circumferential face of the pressure roller 67 is made of elastic material such as sponge, and when the pressure roller 67 is pressed on the resist roller 33, the outer circumferential face of the pressure roller 67 is partially deformed so that the web W comes into surface-contact with the conveyance face 34 of the resist roller 33. When the resist roller 33 comes into contact with the web W wound around the outer circumferential face of the pressure roller 67 while rotating, the foreign matter D is removed from the conveyance face 34 of the resist roller 33 by the web W.

By delivering the web W from the delivery roller intermittently, the used portion of the web W is collected by the winding roller 68 while the unused portion of the web W is brought into pressure-contact with the resist roller 33 by the pressure roller 67. By delivering the unused portion of the web W intermittently to the contact area 65 between the resist roller 33 and the pressure roller 67, the cleaning performance of the cleaning unit 61 to the resist roller 33 is kept constant. Additionally, the web W is wound along one direction, and in order to prevent the inverted winding and loosening of the web W, the delivery roller 66 is provided with a braking mechanism (not shown), and the winding roller 68 is provided with a one-way clutch (not shown).

As shown in FIG. 4 and FIG. 5, the cleaning unit 61 is formed to be long along the lower resist roller 33 (refer to FIG. 3), and includes a cleaning frame 71 which supports the delivery roller 66, the pressure roller 67 and the winding roller 68 in a double support manner. The cleaning frame 71 includes a pair of support frames 72 and 73 facing each other in the front-and-rear direction, a lower frame 74 coupling the lower end portions of the support frames 72 and 73, and a side frame 75 coupling the right side portions of the support frames 72 and 73. Then, the upper face of the cleaning frame 71 is opened, and the web W folded on the pressure roller 67 is exposed through the opened upper face.

Between the upper portions of the support frames 72 and 73, the pressure roller 67 is supported in a rotatable manner. Below the pressure roller 67, between the right side portions of the support frames 72 and 73, the delivery roller 66 is supported in a rotatable manner. Additionally, below the pressure roller 67, between the left side portions of the support frames 72 and 73, the winding roller 68 is supported in a rotatable manner. These three rollers 66, 67 and 68 are supported by the pair of support frames 72 and 73, the support frames 72 and 73 are coupled with each other by the lower frame 74 and the side frame 75, and then a rigidity of the cleaning frame 71 is secured.

The shaft of the pressure roller 67 is provided with a torque limiter 76. When the sheet jamming occurs while the sheet S nipped between the resist rollers 32 and 33 (refer to FIG. 3), it is required to remove the sheet S from the pair of resist rollers 32 and 33. At this time, a rotational force is transmitted from the lower resist roller 33 to the pressure roller 67. Then, if an excessive rotational force is transmitted from the resist roller 33 to the pressure roller 67, the torque limiter 76 rocks the pressure roller 67 to prevent the web W from being delivered from the web roll WR of the delivery roller 66.

On the left lower portions of the outer faces of the support frames 72 and 73, support pins 77 coupled with the unit moving mechanism 62 (refer to FIG. 3) are protruded. On the right upper portions of the outer faces of the support frames 72 and 73, guide rollers 78 which guide the displacement of the cleaning unit 61 to the housing 10 (refer to FIG. 3) are protruded. In the right lower portion of the front support frame 72, an input gear 79 coupled with the web driving mechanism 63 (refer to FIG. 6) is supported. The input gear 79 is coupled with the winding roller 68 via a driving force transmission mechanism (not shown) set in the cleaning frame 71.

The lower frame 74 forms the bottom wall of the cleaning frame 71, and functions as a receiver into which the foreign matter D fallen from the web W and the others is received. The side frame 75 covers the upper half portion of the right side face of the cleaning frame 71 while exposing the lower half portion of the right side face of the cleaning frame 71. By viewing the web roll WR through the opening of the right side face, the cleaning unit 61 with the web roll WR having a small remaining amount is prevented from being incorrectly attached to the housing 10. To the lower frame 74, a sheet member 80 is mounted so as to cover the left side face of the cleaning frame 71 and to prevent the foreign matter D from being scattered to the conveyance belt 45 (refer to FIG. 1).

As shown in FIG. 3, the unit moving mechanism 62 is configured to displace the cleaning unit 61 between a cleaning position P1, a separation position P2 (refer to FIG. 7B) below the cleaning position P1, and an attachment and detachment position P3 (refer to FIG. 7A) below the separation position P2. The cleaning position P1 is a position where the cleaning unit 61 comes into contact with the conveyance face 34 of the resist roller 33, the separation position P2 is a position separated from the cleaning position P1, and the attachment and detachment position P3 is a position where the cleaning unit 61 is attachable and detachable to and from the housing 10. In the cleaning position P1, the cleaning unit 61 is coupled with the web driving mechanism 63 (refer to FIG. 6), and in the separation position P2, the cleaning unit 61 is decoupled with the web driving mechanism 63.

The unit moving mechanism 62 includes a support shaft 91 supported by the housing 10 in a rotatable manner, a pair of front and rear turning arms 92 (only the rear turning arm is shown) fixed to the support shaft 91, and a cleaning motor 94 coupled with the support shaft 91 via a driving force transmission mechanism. The base end side of the turning arm 92 is fixed to the support shaft 91, and in the tip end side of the turning arm 92, a hook 93 with which the support pin 77 of the cleaning unit 61 is engaged is formed. The hook 93 is formed by cutting out the side edge of the turning arm 92 into a long hole, the support pin 77 of the cleaning unit 61 is inserted into the cut out of the hook 93, and then the pair of turning arms 92 supports the cleaning unit 61 in a relatively rotatable manner.

A driving force is transmitted from the cleaning motor 94 to the pair of support shafts 91 to turn the turning arms 92 up and down around the support shaft 91, and then the cleaning unit 61 is positioned in the cleaning position P1, the separation position P2 and the attachment and detachment position P3. The unit moving mechanism 62 includes a first and a second sensors 95 and 96 to detect a position of the cleaning unit 61. The first sensor 95 detects a rotational amount of the cleaning motor 94 by a pulse plate 97 fixed to the output shaft of the cleaning motor 94. The second sensor 96 detects that the cleaning unit 61 is positioned in the cleaning position P1.

The first sensor 95 outputs a pulse signal in response to the rotation of the pulse plate 97 to a controller 120. The controller 120 calculates a rotational amount of the cleaning motor 94 based on the pulse signal output from the first sensor 95. Based on the attachment and detachment position P3 of the cleaning unit 61, a position of the cleaning unit 61 is determined from the rotational amount of the cleaning motor 94. The second sensor 96 outputs a detection signal showing the detection of the cleaning unit 61 positioned in the cleaning position P1. Based on the detection signal output from the second sensor 96, the controller 120 determines that the cleaning unit 61 is positioned in the cleaning position P1.

The cleaning motor 94 is connected to the controller 120, and the rotational amount is fed back from the controller 120 to the cleaning motor 94. Then, a displacement amount of the cleaning unit 61 is adjusted while the cleaning motor 94 servo-controlled. The first sensor 95 only needs to detect the rotational amount of the cleaning motor 94, and the second sensor 96 only needs to detect the cleaning unit 61 positioned in the cleaning position P1. Therefore, the first and second sensors 95 and 96 may be formed by a photo interrupter or a photo reflector. The operation of the unit moving mechanism 62 will be described later.

As shown in FIG. 6, the web driving mechanism 63 is configured to input the driving force to the cleaning unit 61 and to deliver the unused web W toward the conveyance face 34 of the resist roller 33 (refer to FIG. 3). As described above, by positioning the cleaning unit 61 in the cleaning position P1, the web driving mechanism 63 is coupled with the cleaning unit 61 so as to transmit the driving force to the cleaning unit 61. The web driving mechanism 63 is provided with a web solenoid 101 as a driving source, and the web solenoid 101 is driven to rotate the winding roller 68 of the cleaning unit 61 so that the web W is delivered intermittently.

An extendable rod 102 is protruded from the upper portion of the web solenoid 101, when a driving command is input from the controller 120 to the web solenoid 101, the extendable rod 102 is extended or pulled in. On a left side of the web solenoid 101, a turning lever 103 to convert an extending motion of the extendable rod 102 to a rotational motion is provided. The turning lever 103 is supported by the housing 10 via a support shaft 104 in a turnable manner, and formed into an inverted L-shape by a side lever 105 extending sideward from the support shaft 104 and a lower lever 106 extending downward from the support shaft 104. To the side end of the side lever 105, the tip end of the extendable rod 102 is connected, and in the lower end of the lower lever 106, a detection piece 107 is provided.

In the rear end of the support shaft 104, an output gear 108 turned together with the support shaft 104 is provided. To the support shaft 104, the turning lever 103 is coupled via a one-way clutch, and the support shaft 104 is rotated together with the output gear 108 only when the turning lever 103 is turned in one direction. In the present embodiment, when the turning lever 103 is turned in the clockwise direction, that is, when the extendable rod 102 of the web solenoid 101 is pulled in, the output gear 108 is rotated. With the output gear 108 of the web driving mechanism 63, the input gear 79 of the cleaning unit 61 is engaged via a plurality of transmission gears 111 and 112.

Below the lower lever 106, a third sensor 109 to detect the detection piece 107 is provided. The third sensor 109 outputs a detection signal to the controller 120 every time when the detection piece 107 provided in the lower end of the lower lever 106 is detected. The controller 120 calculates a deliver amount of the web roll WR depending on a number of the detection of the detection piece 107 output from the third sensor 109. When the number of the detection is equal to a predetermined number, the controller 120 displays a message for replacement of the cleaning unit 61 on an operation panel (not shown). The third sensor 109 only needs to detect the detection piece 107, and may be formed by a photo interrupter or a photo reflector, for example.

In the deliver operation of the web W in the web driving mechanism 63, the extendable rod 102 of the web solenoid 101 is extended and pulled in depending on the driving command from the controller 120. When the extendable rod 102 is extended, the turning lever 103 is turned in the counterclockwise direction, and the turning lever 103 is idled with respect to the support shaft 104 by the one-way clutch. On the other hand, when the extendable rod 102 is pulled in, the turning lever 103 is turned in the clockwise direction, and the turning lever 103 is turned together with the support shaft 104 via the one-way clutch. Then, the driving force is transmitted from the output gear 108 provided in the rear end of the support shaft 104 to the input gear 79 of the cleaning unit 61 via the transmission gears 111 and 112.

Then, in the cleaning unit 61, the driving force is transmitted from the input gear 79 to the winding roller 68 via the driving force transmission mechanism (not shown), and the web W is wound around the winding roller 68 from the web roll WR of the delivery roller 66. In the above manner, the web driving mechanism 63 delivers the web W from the web roll WR using a small stroke of the extendable rod 102 of the web solenoid 101. In the web driving mechanism 63, the third sensor 109 detects the detection piece 107 every time when the turning lever 103 is turned, and the deliver amount of the web W from the web roll WR is detected.

Furthermore, the controller 120 of the cleaning device 60 may be achieved by a software using a processer, or by a logic circuit (a hardware) formed in an integrated circuit. When the processer is used, the processer performs various processes by reading programs stored in a memory and then executing them. As the processer, for example, a central processing unit (CPU) is employed. The memory is formed by one or more recording mediums such as a read only memory (ROM) or random access memory (RAM) depending on usage.

Figure 7A:
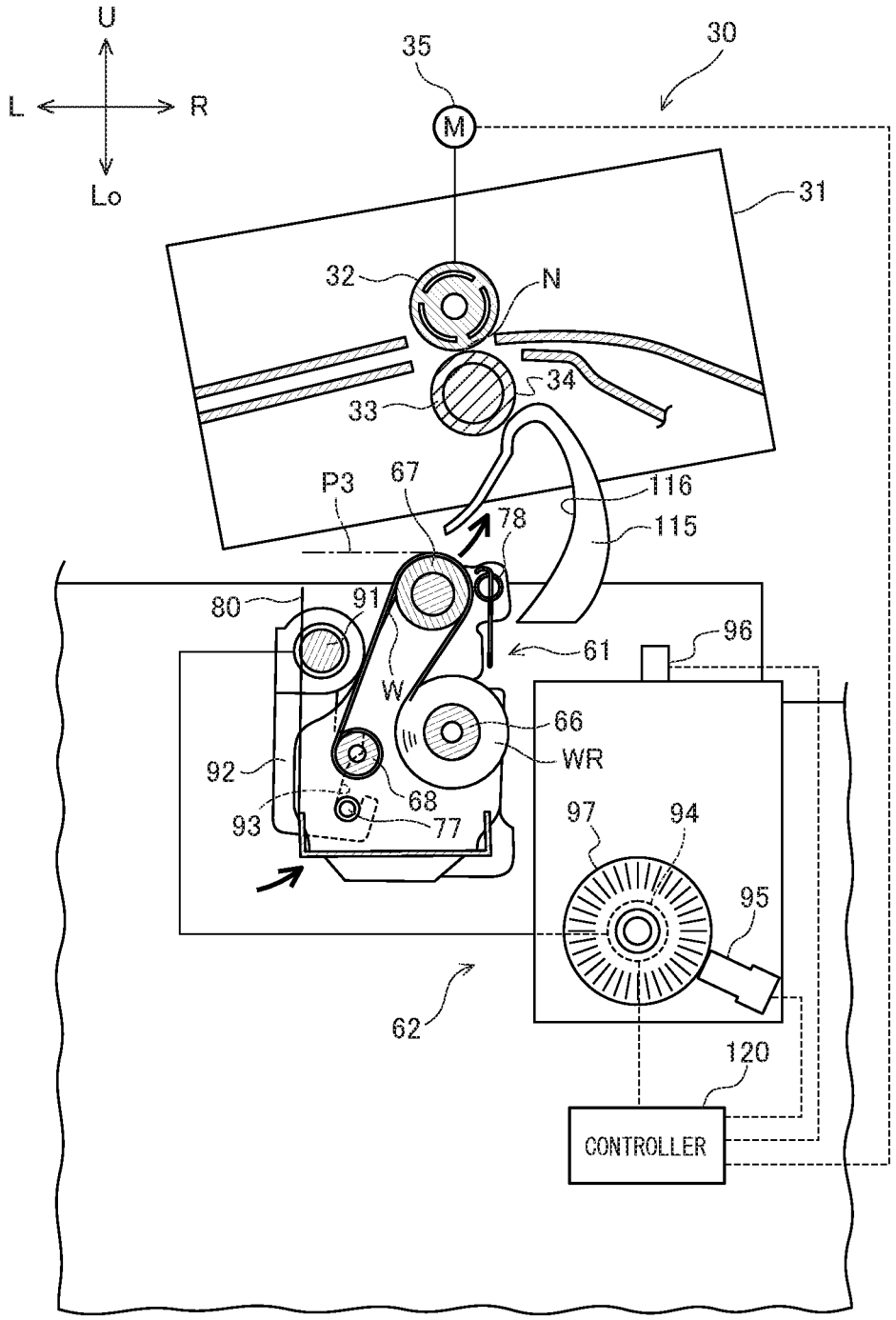
FIG. 7A is a transition diagram showing a movement operation of the cleaning unit in the present embodiment.
Figure 7B:
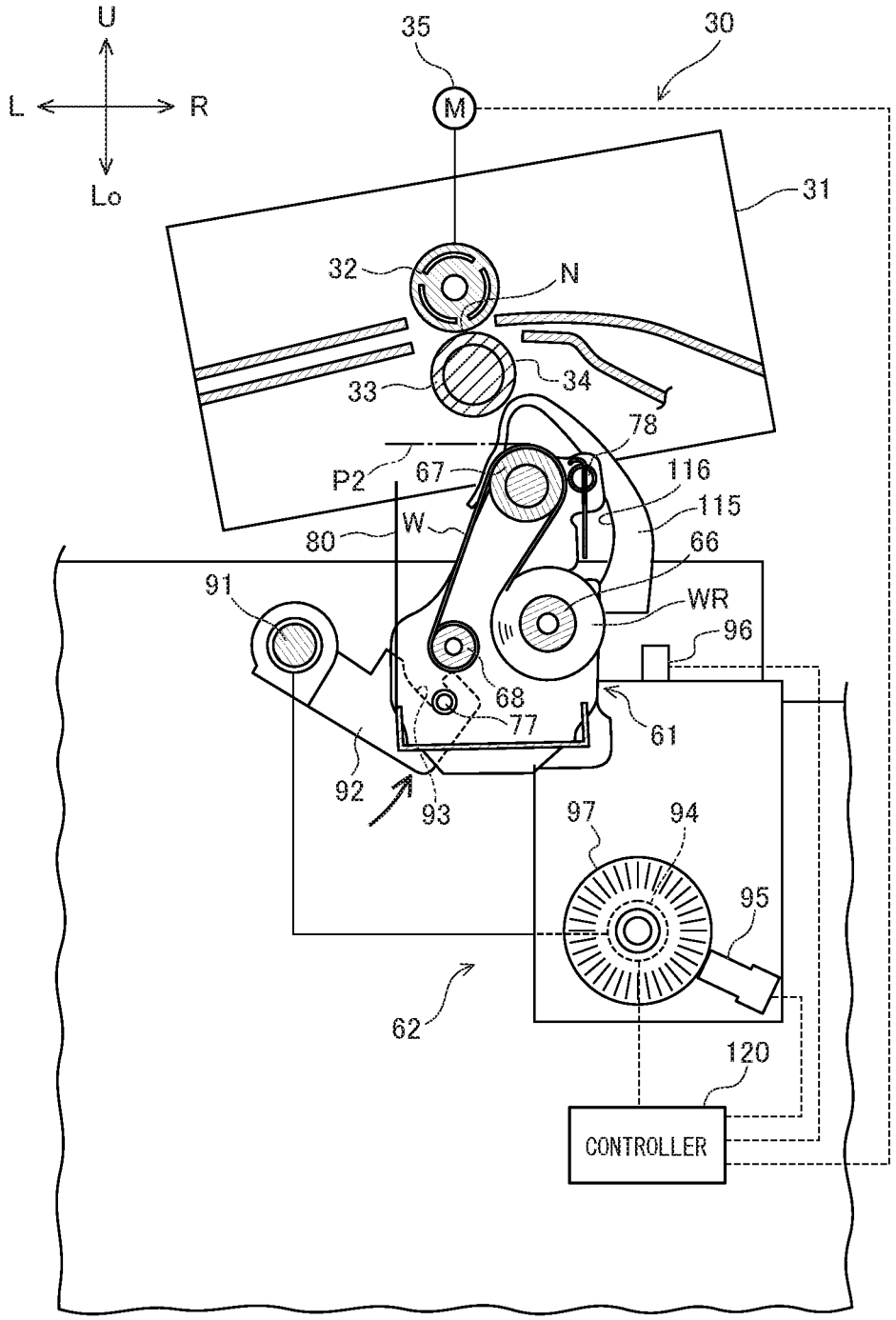
FIG. 7B is a transition diagram showing the movement operation of the cleaning unit in the present embodiment.
Figure 7C:
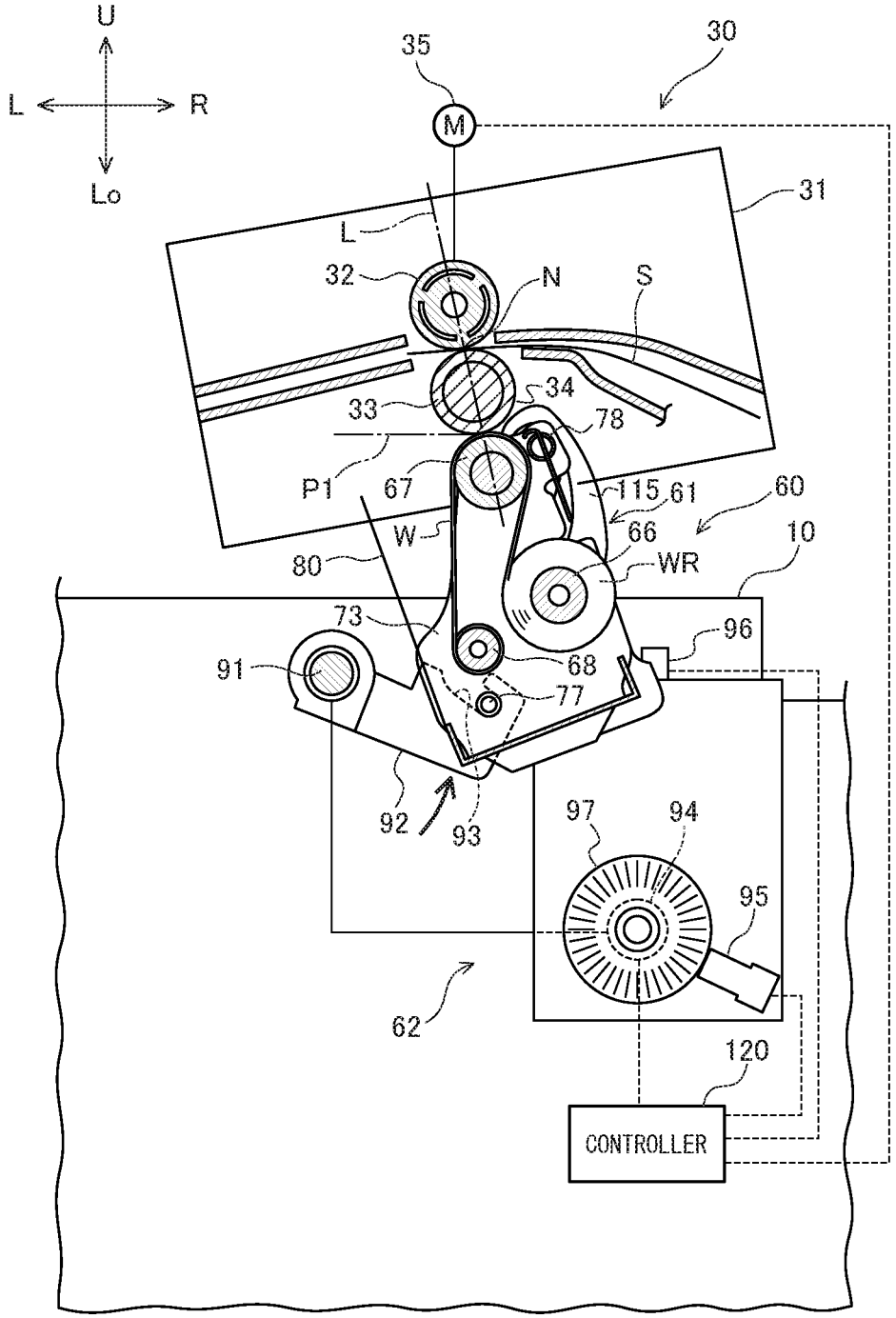
FIG. 7C is a transition diagram showing the movement operation of the cleaning unit in the present embodiment.

A displacement motion of the cleaning device will be described simply. FIG. 7A to FIG. 7C are transition diagrams showing the displacement motion of the cleaning unit in the present embodiment.

As shown in FIG. 7A, the unit moving mechanism 62 includes a pair of front and rear guide parts 115 (only the rear guide part is shown) to guide the cleaning unit 61 from the attachment and detachment position P3 to the cleaning position P1 (refer to FIG. 7C). Each guide part 115 is formed with a guide face 116 coming into contact with the guide roller 78 of the cleaning unit 61. The guide face 116 is curved in an arc shape viewed from the front side in which it is inclined in the right lower direction from the upper position to the middle position and then inclined in the left lower direction from the middle position to the lower position. When the cleaning unit 61 is positioned in the attachment and detachment position P3, the hook 93 of the turning arm 92 faces downward, and the hook 93 supports the support pin 77 of the cleaning unit 61.

When the cleaning motor 94 is driven depending on the driving command from the controller 120, the turning arm 92 fixed to the support shaft 91 is turned upward. Then, the hook 93 of the turning arm 92 pushes up the support pin 77 of the cleaning unit 61, the guide roller 78 of the cleaning unit 61 rolls on the guide face 116 of the guide part 115, and then the cleaning unit 61 is displaced upward from the attachment and detachment position P3. At this time, because the support pin 77 of the cleaning unit 61 is supported by the hook 93 of the turning arm 92 in a relatively rotatable manner, the cleaning unit 61 is brought up smoothly while changing its posture in response to the turning of the turning arm 92.

As shown in FIG. 7B, when the turning arm 92 is further turned, the cleaning unit 61 is positioned in the separation position P2. At the non-cleaning operation for the resist roller 33, the cleaning unit 61 is kept in the separation position P2. As shown in FIG. 7C, when a cleaning command is input from the controller 120 to the cleaning motor 94, the turning arm 92 is further turned, and the cleaning unit 61 is positioned in the cleaning position P1. At this time, the pressure roller 67 is pressed on the resist roller 33 from the lower side, and the resist rollers 32 and 33 and the pressure roller 67 are aligned on a line L passing the centers of these rollers.

Additionally, the cleaning unit 61 and the web driving mechanism 63 (refer to FIG. 6) are coupled with each other. Then, in a state where the web W is brought into pressure-contact with the conveyance face 34 of the resist roller 33 by the pressure roller 67 of the cleaning unit 61, by rotating the resist roller 33, the conveyance face 34 of the resist roller 33 is cleaned by the web W. During the cleaning of the resist roller 33 by the cleaning unit 61, exciting current is continuously supplied to the cleaning motor 94 from the controller 120. This prevents the turning arms 92 from being turned downward, and the cleaning unit 61 is kept in the cleaning position P1.

Next, the separation motion of the cleaning unit at the non-cleaning operation for the resist roller will be described. FIG. 8A and FIG. 8B are transition diagrams showing the separation motion of the cleaning unit in the present embodiment.

As shown in FIG. 8A, at the cleaning operation, the turning arms 92 of the unit moving mechanism 62 (refer to FIG. 7A) are turned upward, and the cleaning unit 61 is displaced in the cleaning position P1. The web W is brought into pressure-contact with the resist roller 33 by the pressure roller 67, the outer circumferential face of the pressure roller 67 is slightly deformed to form the concave contact area 65 between the pressure roller 67 and the resist roller 33. At this time, a pushing up direction A of the cleaning unit 61 by the unit moving mechanism 62 is the same as the direction of the line L passing the centers of the resist roller 33 and the pressure roller 67. Thereby, the web W is strongly brought into pressure-contact with the resist roller 33 by the pressure roller 67, and a cleaning performance for cleaning the conveyance face 34 of the resist roller 33 is enhanced.

Then, the cleaning face of the web W comes into contact with the conveyance face 34 of the rotating resist roller 33, the foreign matter D is scraped and then accumulated on a front side of the contact area 65 between the conveyance face 34 and the web W in the rotational direction of the resist roller 33. At the cleaning operation, the winding roller 68 is intermittently rotated by the web driving mechanism 63 (refer to FIG. 6), and the used web W is wound around the winding roller 68 by a predetermined length. In a state where the cleaning unit 61 is positioned in the cleaning position P1, the used web W fed from the pressure roller 67 to the winding roller 68 extends in approximately the vertical direction. Thereby, the foreign matters D are adhered on the cleaning face of the used web W side by side in approximately the vertical direction at constant intervals.

As shown in FIG. 8B, when the cleaning of the resist roller 33 is completed, the turning arms 92 are turned downward, and the cleaning unit 61 is displaced from the cleaning position P1 (refer to FIG. 8A) to the separation position P2. As described above, the guide face 116 of the guide part 115 is curved in an arc shape, and the upper half portion of the guide face 116 is inclined in the right lower direction from the upper position to the middle position. A center O of gravity of the cleaning unit 61 is positioned on a right side of the support pin 77 coupled to the turning arm 92, that is, on a side of the guide roller 78. Thereby, the cleaning unit 61 is tilted rightward around the support pin 77 owing to the weight of the cleaning unit 61. In the cleaning unit 61 tilted rightward, the guide roller 78 comes into contact with the guide face 116 so that a tilted angle of the cleaning unit 61 is defined. During the displacement of the cleaning unit 61 by the unit moving mechanism 62 from the cleaning position P1 to the separation position P2, the guide roller 78 rolls on the guide face 116 so that the cleaning unit 61 is tilted rightward owing to the weight of the cleaning unit 61.

As a result, as the cleaning unit 61 is displaced from the cleaning position P1 to the separation position P2, the cleaning unit 61 is tilted such that the cleaning face of the used web W between the pressure roller 67 and the winding roller 68 faces upward. That is, the cleaning unit 61 is tilted rightward such that a crossing angle θ of the extending direction of the unused web W with respect to the vertical direction becomes large. At this time, the pushing up direction A of the cleaning unit 61 by the unit moving mechanism 62 is crossed to the direction of the line L passing the centers of the resist roller 33 and the pressure roller 67. Because it is in the non-cleaning operation, the pushing up direction A is not necessarily the same as the direction of the line L, unlike in the cleaning operation.

Because the cleaning face of the web W between the pressure roller 67 and the winding roller 68 faces in an obliquely upward direction, the cleaning face of the web W is positioned below the foreign matter D. Therefore, even if an adhesive force of the foreign matter D to the web W is weak, the foreign matter D is prevented from being removed from the cleaning face of the web W. Additionally, by using the weight of the cleaning unit 61, it becomes possible to face the cleaning face of the web W upward by a simple and inexpensive structure without using a driving source. Furthermore, the cleaning unit 61 is provided with the sheet member 80 facing the cleaning face of the web W between the pressure roller 67 and the winding roller 68. Thereby, when the cleaning unit 61 is displaced from the separation position P2 to the cleaning position P1, the sheet member 80 prevents the scattering the foreign matter D into the inside of the housing 10.

As described above, according to the present embodiment, the web W is brought into pressure-contact with the conveyance face 34 of the resist roller 33 by the pressure roller 67, so that the foreign matter D adhered on the conveyance face 34 is removed by the cleaning face of the web W. Then, the foreign matter D is adhered on the used cleaning face of the web W between the pressure roller 67 and the winding roller 68. As the cleaning unit 61 is displaced from the cleaning position P1 to the separation position P2, the cleaning face of the web W between the pressure roller 67 and the winding roller 68 faces upward so that the foreign matter D is difficulty removed from the cleaning face and it becomes possible to inhibit the contamination of the inside of the housing 10 with the removed foreign matter D.

Furthermore, the image forming apparatus 1 is provided with the above cleaning device 60, so that it becomes possible to inhibit the contamination of the inside of the housing 10 and to form an image on the sheet S stably.

The present embodiment has a configuration in which the cleaning unit is tilted using its weight, but is not limited to the configuration. The cleaning unit may be provided with a driving source, and the cleaning unit may be tilted by the driving source such that the cleaning face of the web between the pressure roller and the winding roller faces upward as the cleaning unit is displaced from the cleaning position to the separation position.

The present embodiment has a configuration in which the winding roller is rotated by the web driving mechanism, but is not limited to the configuration. The cleaning unit may be provided with a driving source such as a motor, and the winding roller may be rotated by the driving source of the cleaning unit.

The present embodiment has a configuration in which the unit moving mechanism displaces the cleaning unit to the cleaning position, the separation position and the attachment and detachment position, but is not limited thereto. The unit moving mechanism only needs to have a configuration to displace the cleaning unit to the cleaning position and the separation position.

The present embodiment describes sheet powder and pigment of the ink as an example of the foreign matter, and the foreign matter is not limited to the sheet powder and the pigment of the ink. For example, the foreign matter may contain dust generated in the housing.

The present embodiment describes a configuration in which the cleaning device cleans the conveyance face of the resist roller, but is not limited thereto. The cleaning device of the present embodiment may clean another conveyance roller.

In the present embodiment, the inkjet type printer is described as an example of the image forming apparatus, but the present embodiment is not limited thereto. The image forming apparatus contains an electrophotographic type printer, a copying machine, a facsimile, and a multifunctional peripheral having a printing function, a facsimile function and other functions.

In the present embodiment, the sheet S may be a sheet-like one on which the image is formed, and contain a plain paper, a coated paper, a tracing paper and a sheet for over head projector (OHP), for example.

Although the present embodiment has been described, as other embodiments, a combination of the above embodiment and modified examples may be employed partially or as a whole.

The technique of the present disclosure is not limited to the above embodiments, and may be modified, substituted or deformed variously without departing from the spirit of the technical idea. Furthermore, if the technical idea can be realized in another way by a development in technology or derived technology, it may be carried out using the way. Accordingly, the claims cover all embodiment that may be contained in the scope of the technical idea.

The present disclosure has been described with respect to specific embodiments, the present disclosure is not limited to the above embodiments. The above embodiment can be modified by those skilled in the art without departing from the scope and sprit of the present disclosure.

The invention claimed is:

1. A cleaning device comprising:

a cleaning unit which removes foreign matter adhered on a conveyance face of a conveyance member conveying a sheet, by using a belt shaped web; and a unit moving mechanism which displaces the cleaning unit to a cleaning position where the cleaning unit comes into contact with the conveyance face and to a separation position separated away from the cleaning position, wherein the cleaning unit includes a delivery roller delivering the web, a pressure roller bringing the web pressure-contact with the conveyance face and a winding roller winding the web passed the conveyance face, and a cleaning surface of the web between the pressure roller and the winding roller of the cleaning unit is in a substantially vertical position when the cleaning unit is positioned in the cleaning position, and faces upward and at an angle to the substantially vertical position when the cleaning unit is positioned in the separation position.

2. The cleaning device according to claim 1, wherein the unit moving mechanism includes a guide part having a guide face which guides a displacement of the cleaning unit, the cleaning unit includes a guide roller which rolls on the guide face as the cleaning unit is displaced, and the cleaning unit is tilted owing to its weight by rolling the guide roller on the guide face.

3. The cleaning device according to claim 1, wherein when the cleaning unit is positioned in the cleaning position, a pushing up direction of the cleaning unit by the unit moving mechanism is the same as a direction of a line passing centers of the conveyance member and the pressure roller, and when the cleaning unit is positioned in the separation position, the pushing up direction of the cleaning unit by the unit moving mechanism is crossed to the direction of the line passing the centers of the conveyance member and the pressure roller.

4. The cleaning device according to claim 1, wherein the cleaning unit includes a sheet member facing the cleaning face of the web between the pressure roller and the winding roller.

5. The cleaning device according to claim 1, wherein in a state where the cleaning unit is positioned in the cleaning position, the used web fed from the pressure roller to the winding roller extends in approximately a vertical direction, and as the cleaning unit is displaced from the cleaning position to the separation position, the cleaning unit is tilted such that the cleaning face of the used web between the pressure roller and the winding roller faces upward.

6. The cleaning device according to claim 1, wherein the conveyance member is a resist roller, the cleaning face of the web is brought into contact with the conveyance face of the rotating resist roller such that the foreign matter is scraped and then accumulated in front of a contact area between the conveyance face and the web in a rotational direction of the resist roller, and the winding roller is rotated intermittently so that the used web is wound around the winding roller by a predetermined length.

7. An image forming apparatus comprising:

an image forming part which forms an image on the sheet, and the cleaning device according to claim 1.

8. A cleaning device comprising:

a cleaning unit which removes foreign matter adhered on a conveyance face of a conveyance member conveying a sheet, by using a belt shaped web; and a unit moving mechanism which displaces the cleaning unit to a cleaning position where the cleaning unit comes into contact with the conveyance face and to a separation position separated away from the cleaning position, wherein the cleaning unit includes a delivery roller delivering the web, a pressure roller bringing the web pressure-contact with the conveyance face and a winding roller winding the web passed the conveyance face, the cleaning unit is tilted such that a cleaning face of the web between the pressure roller and the winding roller faces upward as the cleaning unit is displaced from the cleaning position to the separation position, when the cleaning unit is positioned in the cleaning position, a pushing up direction of the cleaning unit by the unit moving mechanism is the same as a direction of a line passing centers of the conveyance member and the pressure roller, and when the cleaning unit is positioned in the separation position, the pushing up direction of the cleaning unit by the unit moving mechanism is crossed to the direction of the line passing the centers of the conveyance member and the pressure roller.

9. An image forming apparatus comprising:

an image forming part which forms an image on the sheet, and the cleaning device according to claim 8.

10. A cleaning device comprising:

a cleaning unit which removes foreign matter adhered on a conveyance face of a conveyance member conveying a sheet, by using a belt shaped web; and a unit moving mechanism which displaces the cleaning unit to a cleaning position where the cleaning unit comes into contact with the conveyance face and to a separation position separated away from the cleaning position, wherein the cleaning unit includes a delivery roller delivering the web, a pressure roller bringing the web pressure-contact with the conveyance face and a winding roller winding the web passed the conveyance face, in a state where the cleaning unit is positioned in the cleaning position, the used web fed from the pressure roller to the winding roller extends in approximately a vertical direction, and as the cleaning unit is displaced from the cleaning position to the separation position, the cleaning unit is tilted such that a cleaning face of the used web between the pressure roller and the winding roller faces upward.

11. An image forming apparatus comprising:

an image forming part which forms an image on the sheet, and the cleaning device according to claim 10.

* * * * *